US006000147A

United States Patent [19]

Kellerman

[11] Patent Number: 6,000,147

[45] Date of Patent: Dec. 14, 1999

[54] THREE SECTION ORTHOTIC DEVICE

[75] Inventor: David Kellerman, Santa Barbara, Calif.

[73] Assignee: Kellerman, Beverly Hills, Calif.

[21] Appl. No.: 09/118,402

[22] Filed: Jul. 17, 1998

[51] Int. Cl.[6] ..... A43B 23/00

[52] U.S. Cl. ..... 36/44; 36/160

[58] Field of Search ..... 36/43, 44, 71, 36/155, 159, 160

[56] References Cited

U.S. PATENT DOCUMENTS

| | | | |
|---|---|---|---|
| 945,698 | 1/1910 | Conway | 36/3 B |
| 1,960,418 | 5/1934 | Schaller | 36/71 |
| 2,037,970 | 5/1936 | Everston | 36/19 |
| 2,200,849 | 5/1940 | Margolin | 36/3 |
| 2,979,835 | 4/1961 | Scholl | 36/44 |
| 4,297,797 | 11/1981 | Meyers | 36/44 |
| 4,633,877 | 1/1987 | Pendergast | 128/581 |
| 4,756,096 | 7/1988 | Meyer | 36/44 |
| 4,782,605 | 11/1988 | Chapnick | 36/44 |
| 4,813,157 | 3/1989 | Boisvert et al. | 36/44 |
| 4,841,648 | 6/1989 | Shaffer et al. | 36/43 |
| 4,955,148 | 9/1990 | Padilla | 36/44 |
| 4,999,931 | 3/1991 | Vermeulen | 36/29 |
| 5,138,774 | 8/1992 | Sarkozi | 36/164 |
| 5,154,682 | 10/1992 | Kellerman | 36/44 |
| 5,435,077 | 7/1995 | Pyle | 36/28 |
| 5,438,768 | 8/1995 | Bauerfeind | 36/44 |
| 5,463,824 | 11/1995 | Barna | 36/44 |
| 5,551,173 | 9/1996 | Chambers | 36/44 |
| 5,799,414 | 9/1998 | Kellerman | 36/160 X |

FOREIGN PATENT DOCUMENTS

| | | |
|---|---|---|
| 31 31 163 A1 | 3/1983 | Germany . |
| 4-276205 | 10/1992 | Japan . |

*Primary Examiner*—B. Dayoan

*Attorney, Agent, or Firm*—John M. May; Fulbright & Jaworski

[57] ABSTRACT

An orthotic which comprises an upper section and a lower section which can be hinged to each other by a hinge. The facing surfaces of the sections are covered with sheets of loop material. Compressible cushion pads designed to contour to the specific needs of a patient containing a layer of hook material on both surfaces are releasably secured to the sheets of loop fabric forming a three layer assembly.

14 Claims, 11 Drawing Sheets

THREE SECTION ORTHOTIC DEVICE

CROSS-REFERENCE TO RELATED APPLICATION

This application relates to the invention disclosed in Disclosure Document No. 424,087 filed Sep. 2, 1997. Retention of the Disclosure Document is respectfully requested.

TECHNICAL FIELD

This invention relates to a device for enhancing the comfort of wearers of shoes and, more particularly, to an insert for shoes having a high level of shock absorption and shear reduction capabilities that lead to alleviation of symptoms of foot irritation and foot disease.

BACKGROUND OF THE INVENTION

Foot disease such as minor irritation, rashes, calluses, corns, bunions and ingrown toe nails to more severe traumatic conditions such as heel spurs are endemic. Many of these conditions such as bunions are hereditary. However, all of these conditions are aggravated by abrasion or rubbing and many are solely attributable to irritation caused by abrasion. Many people suffer from skin irritation even when using the best made shoes or using shoe inserts such as arch supports.

Doctors of Medicine (M.D.) and of Podiatric Medicine (D.P.M.) are specially trained in the treatment of diseases of the feet. A sub-specialty, Sports Medicine, has recently been recognized. Though doctors who specialize in Sports Medicine treat all trauma related to athletics, many of the conditions they treat deal with the feet. Some of the most common problems include heel spurs, corns, bunions and calluses on the ball of the foot. Most of these traumas arise due to pressure from an underlying bone structure. There is also a large population of people who regularly run or play ball on hard unyielding surfaces which can cause or aggravate the above-described traumas. The usual therapy is surgical removal, sometimes followed or preceded by prescriptions of a biomechanical device, physiotherapy or topical or oral medication. Oral anti-inflammatory medicine can cause stomach upset and in some cases leads to inflammed or bleeding stomach ulcers.

One alternative to surgery is the use of a rigid, molded, shaped orthotic. These devices are designed to correct the angular relationships between the various segments of each foot resulting in more normal functioning of the feet and legs. The end result is intended to decrease or eliminate foot symptoms, corns and calluses. Orthotics that are formed of a rigid synthetic resin material are usually not comfortable and require a long period of adjustment. Furthermore, the rigid orthotic is expensive. Because of their high cost, most patients prefer to buy only one pair and use that single pair in the shoes that they are presently wearing. However the rigid orthotic may occupy so much volume of the wearer's shoe as to cause excessive pressure on the foot. The wearer may be required to buy larger shoes. Finally, though these devices do provide a more anatomically correct alignment of the foot and a reduction in pressure on stress points, they do not eliminate irritation caused by rubbing of the foot against the inner surface of the shoe, sport shoe, ski boot, etc.

The rigid, fixed orthotics are designed to correct various problems that may be congenital or have developed from wearing incorrect footwear. Problems requiring orthotic correction may also result from injuries as well from excessive standing, poor working conditions, sports activities, numerous diseases such as diabetes or the loss of padding on the bottom of the feet as the body ages.

Common methods of treatment have been developed to support the bottom of the feet, on their plantar aspect, to restore their normal functions while seeking to correct any symptomatic abnormalities without resorting to surgery.

In general, the footcare professional will make molds of the patient's feet. The mold is then analyzed and a prescription for a rigid or flexible fabricated orthotic having a fixed contour is sent to a laboratory that will custom mold the necessary corrective or accommodative orthotic. The molded orthotic is then sent to the footcare professional to be fitted in the patient's footwear.

If these molded orthotics need additional adjustments they either have to be returned to the fabrication facility for modification or the footcare professional has to maintain a workshop in order to be able to trim and adjust the orthotic units to suit the needs of the patient.

The molded orthotics, whether rigid or flexible, are made using special tools. The final product is a specially molded, rigid pad which provides the necessary foot contacting curvatures and contours. These pads are expensive to produce and require specialized molding equipment.

Once the fabricated orthotics have been molded, the patients are advised to wear their new orthotics only for a short time each day, until their feet get used to them. This "breaking-in" process may be too uncomfortable for the patient to bear and sometimes cause the patient to stop using the orthotic and/or seek alternative treatment.

In many cases, the patient will purchase widely advertised shoe inserts that will for a time seem to reduce pain and discomfort. These products generally fail to truly provide the necessary comfort or required correction of the underlying foot problems. Many experiences with fixed orthotics are often time consuming and painful for the patient and frustrating for the footcare provider.

It has been discovered that even with the best adjustment of the foot, the foot will still move slightly in the shoe, slipper or boot relative to the shoe's interior surface while the patent is walking or running. This movement or slippage is also caused by the molded orthotic not being the precise length of the shoe into which it is placed. This undesired foot movement will progressively lead to discomfort, irritation and then trauma.

STATEMENT OF THE INVENTION

The novel orthotic of the invention is a foot-shaped assembly designed to be worn inside the user's footwear. the orthotic is intended to function as an alternative to "fixed" orthotics.

The orthotic of the invention provides greater comfort to the user and affords footcare professionals including podiatrists, orthopedists, pedorthists, physical therapists, chiropractors and their technicians, more rapid achievement of treatment objectives with significant time savings and cost reductions. The orthotic of the invention has a simple step by step adjustment capability.

The novel orthotic comprises three parts: an upper and lower section, which can be hinged to each other and one or more center pads sandwiched between the sections. The hinging means connecting the upper and lower sections together facilitates proper alignment of the sections to one another in a quick manner.

The upper section is a flat, foot-shaped, first lamination of:

a.) a first layer of material having a foot-contacting surface layer made from material which preferably will not irritate the bottom of a patient's foot such as a natural material such as leather or a synthetic resin material such as high density polyethylene;

b.) a resilient cushioning layer which can be continuous or formed of discrete pads, preferably made from a closed cell synthetic foam material such as PORON; and, c.) a foot plantar aspect shaping or molding layer such as a natural material such as leather or a synthetic resin material, suitably High Density Polyethylene (HDPE).

The first layer is sufficiently thick and flexible to deform over pads placed under the layer, especially sharp-edged, die-cut resilient pads. The first layer will deform into a smooth ramp along the perimeter of the pad under the force of the weight of the user and will maintain the deformed shape when the force is removed.

The upper section lamination may also include an additional layer or layers of flexible material such as vinyl, loop cloth or other material.

The third layer may consist of a flat, lamination of a foot-shaped sheet of Velcro-type loop or hook material bonded to a thin foot-shaped sheet of HDPE or other suitable material.

The upper and lower sections can be connected together by a hinging means so that in the closed position, the bottom surface of the upper section faces the top surface of the lower section. Preferably, the hinging means comprises a strip of Velcro-type loop material although any other type of fabric or pliable plastic may be used in the alternative. The hinge can be a live hinge formed by molding or stamping the first and third layers from a single sheet of material.

In the preferred embodiment of a hinged orthotic, an elongated strip of the loop material is permanently attached to one end of the lower section. The strip extends and becomes part of the upper section laminate as described above with the portion of the strip between lower and upper sections forming a hinge. The strip further extends through and past the upper section and forms a flap. On the bottom side of the lower section contains an area of hook fabric. A portion of the strip of hook fabric may be secured to the lower section by adhesive, thermal welding or by any other suitable means. From the open position, the hinge is used to position the upper and lower sections in contact with each other and the flap end of the Velcro strip is partially wrapped about the device and into temporary locking engagement with the area of hook fabric.

The hinge provides proper alignment between upper and lower sections. A hinge is not necessary however, so long as upper and lower sections are aligned properly and are not allowed to slide out of alignment such as by providing Velcro loop fabric on each side of the pads and on each facing surface.

Sandwiched in between the lower and upper sections can be a variety of pads of suitable shapes, materials and thickness which have some portion of their generally flat bottom surfaces bonded to a layer having opposed surfaces of Velcro-type hook material mounted on the pads. The pads are easily attached to and removed from the-loop-bed surface present on the inside face of either the lower or upper section. The pads provide support and correction by the shaping and contouring of the upper section as required by the footcare professional to treat the patient's specific condition. The pads can be of any desired shape or thickness and the pad's resiliency can be either firm or soft. The pads can be manufactured by molding or stamping.

With the desired pad configuration sandwiched between upper and lower sections, the orthotic of the invention is then placed in the user's shoe. The pads will not move from their attachment locations on the loop-bed because of the Velcro-type bond between the hooks on the pads and the loops on the opposed surfaces. The position of the pads remain secure while the wearer is at rest, walking or engaging in vigorous sports activities.

It is probable that after the first positioning of the pads, future adjustments will be necessary. With Velcro-type attachment, the upper and lower sections can be separated from one another and the position of the pad can be readily changed.

Adhesive attachment of the pads to the upper or lower section is not desirable. Over time, as body weight is transmitted to the pad area, shearing forces will occur which will eventually cause pad sliding to occur. Further, pads that use adhesives cannot be detached and re-attached without loss of bonding strength and shear resistance.

The thin HDPE layer in the upper-section of the laminate has the special property of molding to the contour of the positioned pads and retaining this shape until the pads are detached from the loop bed or moved to a different position on the loop bed. After each successive adjustment of the pads by the footcare professional, the upper section will always remold to the new desired shape and contour. The primary objective for these adjustments is to deliver the necessary correction, support or comfort to the plantar aspect of the wearer's foot. Furthermore, with pads having a vertical edge, the top layer will mold over the edges of the pad to form smooth, gradual, comfortable transitions between the surface of the top layer and the top surface of the pad.

As the orthotic device of this invention bears the weight of the user, the upper section will develop a support shape over the area where the pads are located such as in the arch area. Similarly, wherever hook coated pads are placed on the loop fabric to supplement or relieve the plantar areas of the foot or to obtain corrective and other foot support, the upper section will mold to the shape desired by the footcare specialist to provide the necessary treatment for the specific condition or conditions.

The footcare professional will, upon initial evaluation, examine the patient to determine whether the pad arrangement of the adjustable orthotic of this invention is effective. If not, he will change or reposition the pads. The footcare professional using the system of the invention will stock various shoe sizes of the orthotic and various pads in different shapes.

The pads and upper and lower sections are distinct from and are not expensive to manufacture compared to custom made, molded fixed orthotics. The pads can be molded, cut or stamped from a sheet material, preferably a resilient cushioning material and most preferably a closed cell polyurethane foam material such as PORON. By utilizing a sheet of material having a uniform thickness, identical pads can be mass-produced by a stamping process. This type of production process significantly reduces the orthotic pad cost.

With a variety of pad shapes in stock, a footcare professional can quickly modify the contour of the orthotic of the invention by altering the placement of pads disposed between upper and lower sections. As the situation warrants, the pads may be stacked upon one another in-between the upper and lower sections to provide for an elevated support such as in the arch area of the foot. The fitting of the orthotic to a patient's foot can occur during the patient's first visit. Within a short time after placing the pads of appropriate thickness and shape in their proper locations, the footcare professional will be able to determine, with help of some brief tests, whether the patient can walk with more comfort and whether the necessary correction or accommodation can be provided. There will no longer be a need for a lengthy delay between taking a mold of the patient's foot, waiting for a custom orthotic to be made and the scheduling of a second appointment for fitting. The patient can return in a few days or weeks for follow-up to see if other adjustments or pad changes are required. The fitting process is so simplified that the footcare professional can assign a medical technician or therapist for the follow-ups. The time needed for these visits is minimal thus permitting the footcare professional to have more time for other patients.

The gentle, non-irritating contours, lifts and slopes developed by the upper section offer immediate, customized comfort for the patient. Unlike fabricated, rigid orthotics, there is no painful breaking-in period required. Since overall discomfort has now been quickly reduced, the patient can more clearly describe to the footcare professional where further adjustment may be necessary.

Over a period of time, after using softer, more resilient pads to permit healing of irritated or painful areas, the footcare professional may elect to replace the soft pads and substitute firmer ones if the patient can tolerate firmer materials needed to provide for a more specific correction or comfort.

With the novel orthotic system, the patient will achieve correction and lasting comfort in less time. Patient frustration with the overall process will considerably diminish.

Patients with diabetes-related foot problems will greatly benefit from reduced skin irritation and an increased ability to engage in a more active lifestyle, a known method for lowering blood sugar levels. The Velcro-attachment, pad exchange system of the invention can also be used to meet these various needs by permitting the placement of a firmer or softer pad, larger or otherwise shaped pads, thinner or thicker ones, etc. By choosing from a selection of different pad thicknesses, sizes, shapes or resilience and by combining several pads in a piggy back manner, the range of adjustments will be limited only by the insight and experience of the footcare professional.

The compressible layer within the upper section can be ordered from the manufacturer in a variety of thicknesses and resiliencies to accommodate lightweight or heavy patients alike, or the very active or sedentary patients. Apertures can be die-cut out of the layer in the upper section below the cover layer to provide a cavity below sensitive, painful areas of the foot. These apertures can be provided on differently pre-fabricated models to achieve comfort and correction in multiple zones of the plantar aspect of the foot including the heel and metatarsal areas.

In addition to the advantages offered by using Velcro-type, fine tuning methods of locating, relocating and exchanging pads on loop fabric, the upper section can be laminated with many combinations of material and layer positions as a means of obtaining a choice of correction and comfort results.

It has been found that there is a need for varied foot support and cushioning levels. Patients can select the appropriate cushioning to suit the needs of different types of activities. This need is demonstrated by the various specialized footwear configurations that are now available for running, tennis, basketball, and other activities.

1. Heel Cup Attachment

A heel cup for the 3-section orthotic can assist patients with feet that have narrow heels and wide forefeet areas. For these patients, it is very difficult to purchase suitable shoes that will maintain a patient's heel in place and prevent movement and possible ankle turn-out injuries.

The heel cup is a lightweight, flexible unit with a flat bottom and walls that flair out slightly, preferably between 2 to 6 degrees. The heel cup is shaped to receive and mate with the heel portion of the 3-section orthotic. The heel cup is removably attached to the bottom side of the lower section of the 3-section orthotic. Preferably, a layer having Velcro-hook type material is attached to the top side of the heel cup seat and is designed to mate with Velcro loop-type material attached to the heel area on the bottom side of the lower section of the 3-section orthotic.

The heel cup is also designed to allow the footcare professional to position an orthotic post in the heel area to provide correct alignment of the heel and ankle. A layer having Velcro-loop material is attached to the bottom side of the heel cup. The orthotic post has a layer of Velcro-hook material attached to one side. The orthotic post can then be attached to the most desirable location on the bottom of the heel cup to deliver the necessary angular correction. The orthotic post can be made in varying thickness and also of any material, however, it is preferably made from a rigid plastic material.

The inside surface of the wall of the heel cup is very smooth to prevent abrasion injury to heel and Achilles tendon areas. The heel cup's outer side walls can be equipped with Velcro-type mating areas which can be attached space filling pads of various thickness' to achieve the exact fit needed in each footwear.

2. Heel Pad

The top rear surface area of the upper-section has a soft round nesting bowl area for receiving the calcaneus region of the user's heel bone. To further cushion this region, a heel pad can be placed on top of the rear portion of the loop bed of the lower section. This heel pad can be thin or thick, soft or firm to suit the needs of the patient.

The pad can have a hole in its center aligned with the nesting bowl of the upper section directly above it, for increased nesting depth.

An adjustment of resilience for the calcaneus area can be provided by inserting a plug or cylindrical column of resilient Poron or suitable material, having a slightly smaller diameter, into the pad hole.

For adjustability to suit plantar fascitis relief, the plug length can be thinner or thicker than the heel pad and can be either soft or firm.

The heel pad provides adjustability for heel strike shock absorption and is designed to help treat plantar fascitis, heel spurs and other conditions affecting the calcaneus region.

3. Extender Element

The extender element is an attachment that allows the 3-section adjustable orthotic to fit the full inside length of the footwear. The extender element consists of a piece of thin, rigid HDPE or other suitable material, partially covered on one side with Velcro-hook type material and is designed to be removably attached to the Velcro-loop bed at front end of the lower section. The extender element can be adjusted into a position at the front of the unit so that it will enable the 3-section unit to fit snugly into the user's footwear without sliding back and forth.

By providing an extender element, half sizes of the orthotic need not be manufactured. Full sizes can be "extended" to fit into slightly larger shoes thereby eliminating the need to trim a larger sized orthotic down to the exact shoe dimension.

4. Slim Line Version Description

A thinner version of the 3 section adjustable orthotic assembly is designed to fit into footwear with limited interior space such as in dress shoes.

Although the thin version cannot provide all the features and comforts of the full-size adjustable orthotic, the thin version offers superior comfort and correction when used with space limited footwear compared to other orthotics available.

To achieve this size reduction, the following differences between the two styles of orthotics are present:

1. The upper section slim lamination uses thinner materials in each of the multiple layers to conserve space.
2. To allow for limited toe box height, the lower section of the thin model is approximately ¾ of the full size length for the upper section.
3. The same pads with hook material on at least its upper face are used but in minimum thicknesses.
4. Heel cups and heel pads can be attached if required, using reduced dimensions, to fit the space provided by smaller footwear.
5. To restrain the assembly from sliding forward into the toe box area, a piece of Velcro-type thin hook material can be separately and permanently attached to the inside rear top surface of the sole. An area of Velcro-loop type material on the bottom of the lower section rear can be provided to allow the unit to be removably mated to the piece of hook-type Velcro material described above.
6. Pads of various shapes and thicknesses, with Velcro-type hook material on one side can be releasably attached to the lower section loop bed to provide padding at the front of the unit. The figures will illustrate this more clearly.

Advantages of the Adjustable Orthotic System:

The invention will benefit both patient and the footcare professional with its many features of adjustability of fit, resilience, support, pressure relief, heel and general foot structure re-alignment.

Some of the key advantages are:

1. A system that is easier for the footcare professional to use.
2. The quick attach and relocate system for movement of assorted pads provides for many possibilities of adjustment not available with any other system.
3. The size extender element eliminates the need to produce half size orthotics and assures the proper fit of the 3 section adjustable orthotic in the user's footwear.
4. The optional heel cup with adjustable heel tilt and lift, and adjustable heel grip with side padding which can be added by Velcro-type attachment.
5. All necessary pads can be fabricated from lower cost, readily available flat sheet stock as an alternative to costly, specially molded components.
6. The foot conforming quality of the upper-section when pads are placed beneath it for corrective purposes, makes it now possible to achieve superior comfort in reduced time and at much lower cost than by using conventional molded pads that usually directly contact the plantar areas of the feet.
7. The ability of sandwiching die cut or scissors cut pads made from lower cost, flat sheet stock materials and placing these pads onto the lower loop section and beneath the upper section acts as a buffer. The result being every cut pad is felt by the foot as a soft rounded lift with smooth slope rises.

If packaged pre-cut pads are not available from stock, the footcare professional can cut the desired shape from sheets of cushioning material with Velcro-type hook material bonded to one side using a pair of scissors.
8. The SLIMLINE version can be placed in footwear with limited toe-box area. This version is especially important for women whose dress and casual shoes cannot accommodate thicker orthotics.
9. A simple low cost method of manufacture using 2 guide-holes for lamination of the assembly for the upper and lower sections.

These and many other features and attendant advantages of the invention will become apparent as the invention becomes better understood by reference to the following detailed description when considered in conjunction with the accompanying drawings.

DETAILED DESCRIPTION OF THE INVENTION

Figure 1:
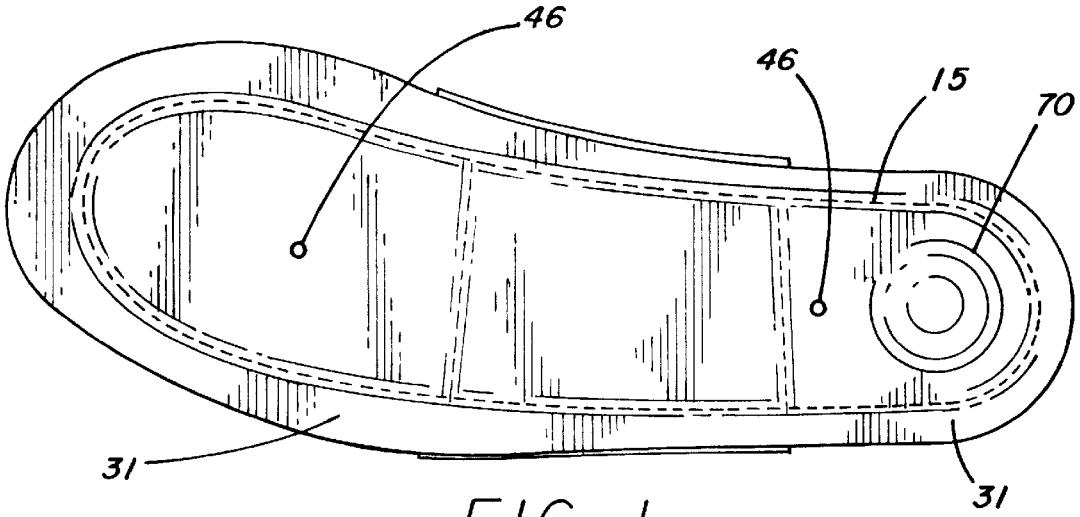
FIG. 1 is a top view of the orthotic device of the invention in its closed configuration ready for use.
Figure 2:
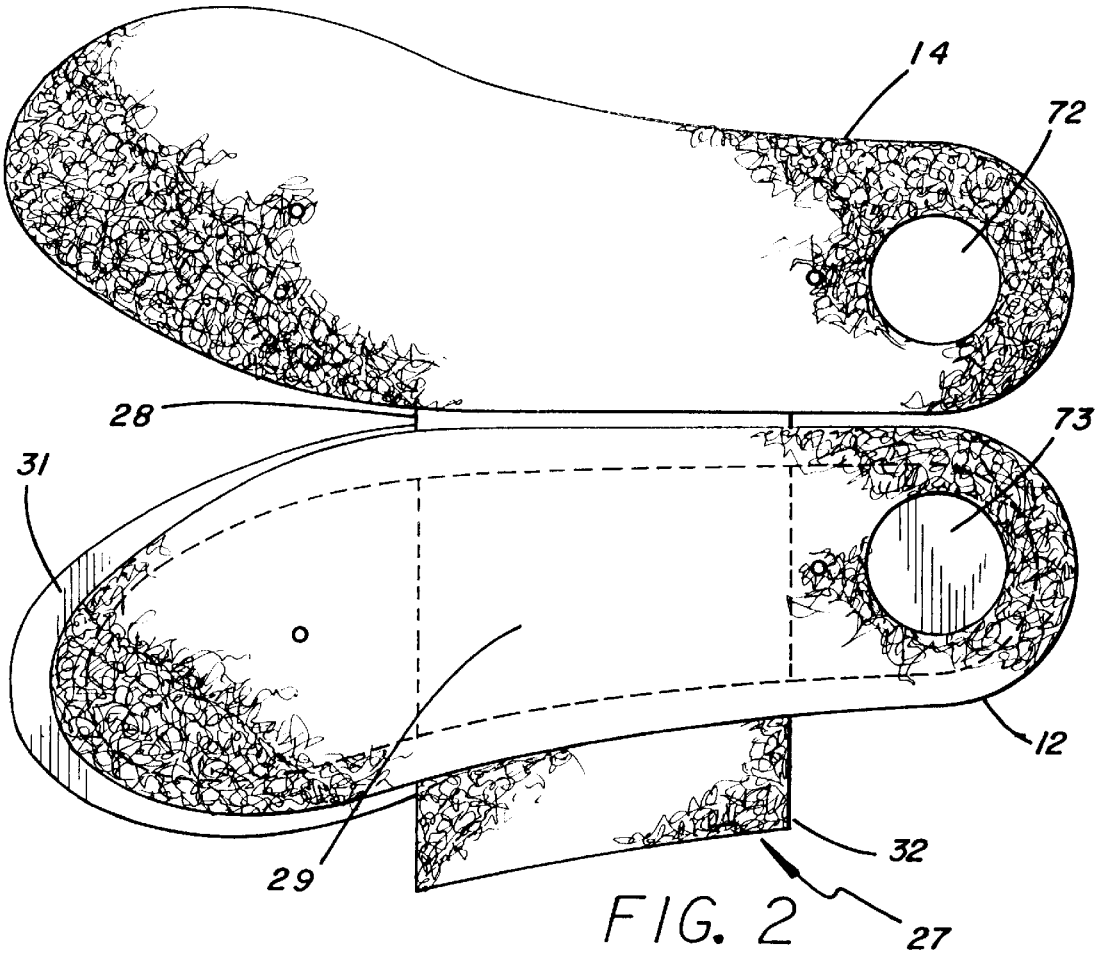
FIG. 2 is a top view of the orthotic device of the invention in its open configuration illustrating the Velcro loop surfaces of the upper and lower sections.
Figure 3:
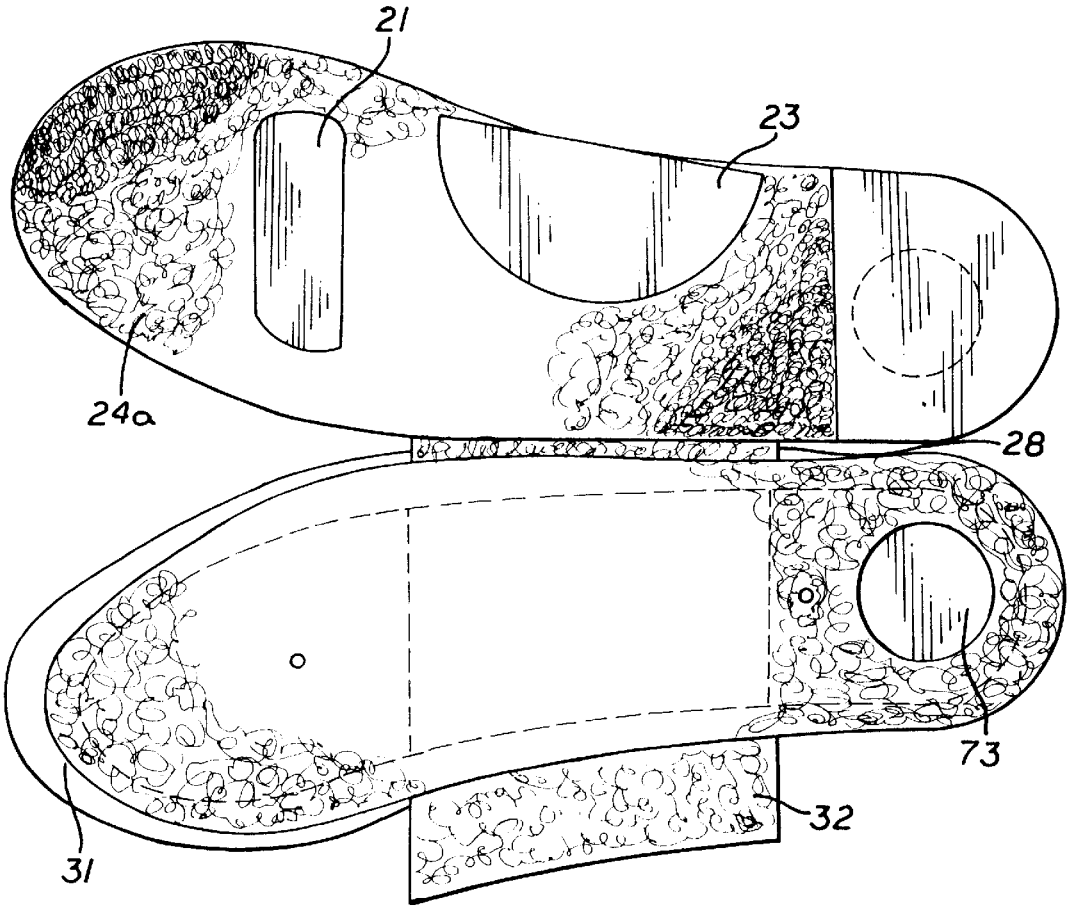
FIG. 3 is a top view of an orthotic device illustrating the use of cushion pads positioned upon the Velcro surface of FIG. 2.
Figure 4:
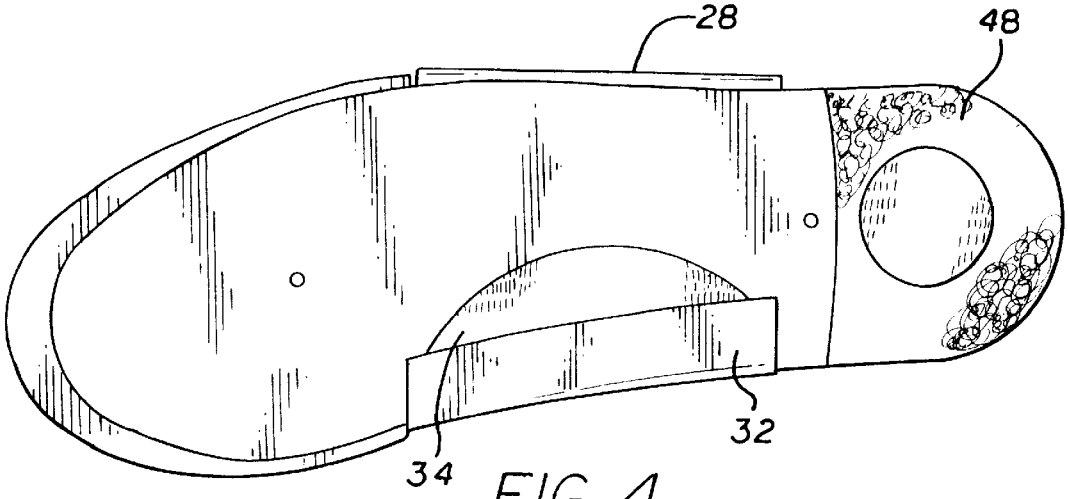
FIG. 4 is a bottom view of the orthotic device in a closed configuration ready for use.
Figure 5:
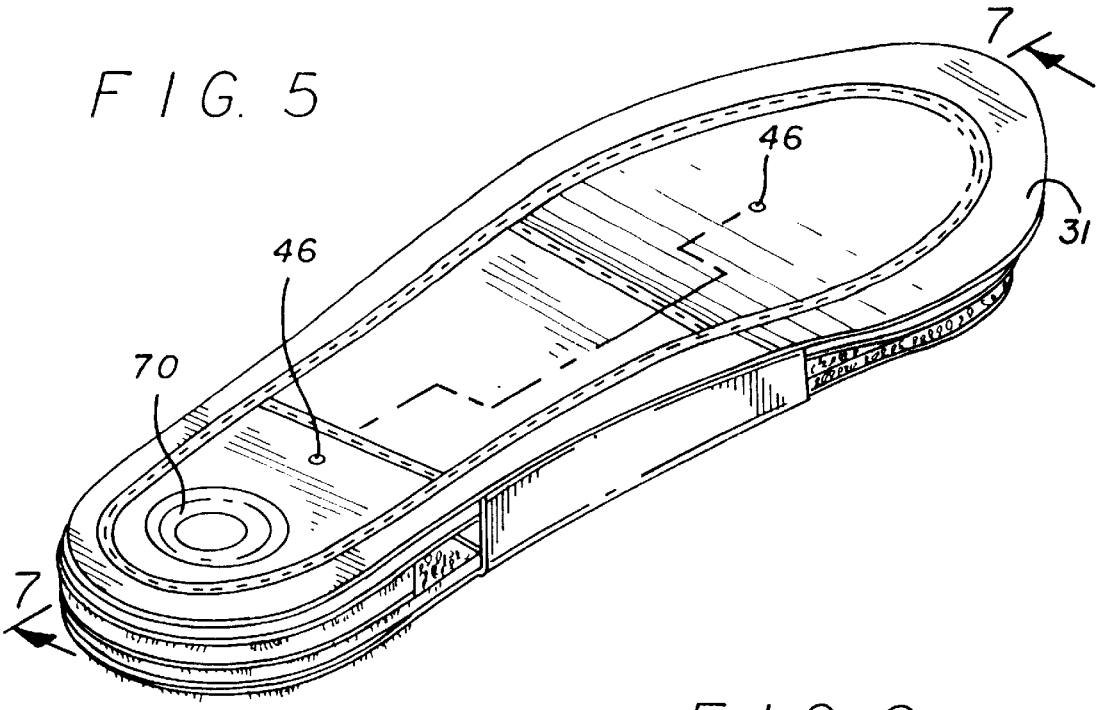
FIG. 5 is a perspective view of the orthotic device of the invention ready for use.
Figure 6:
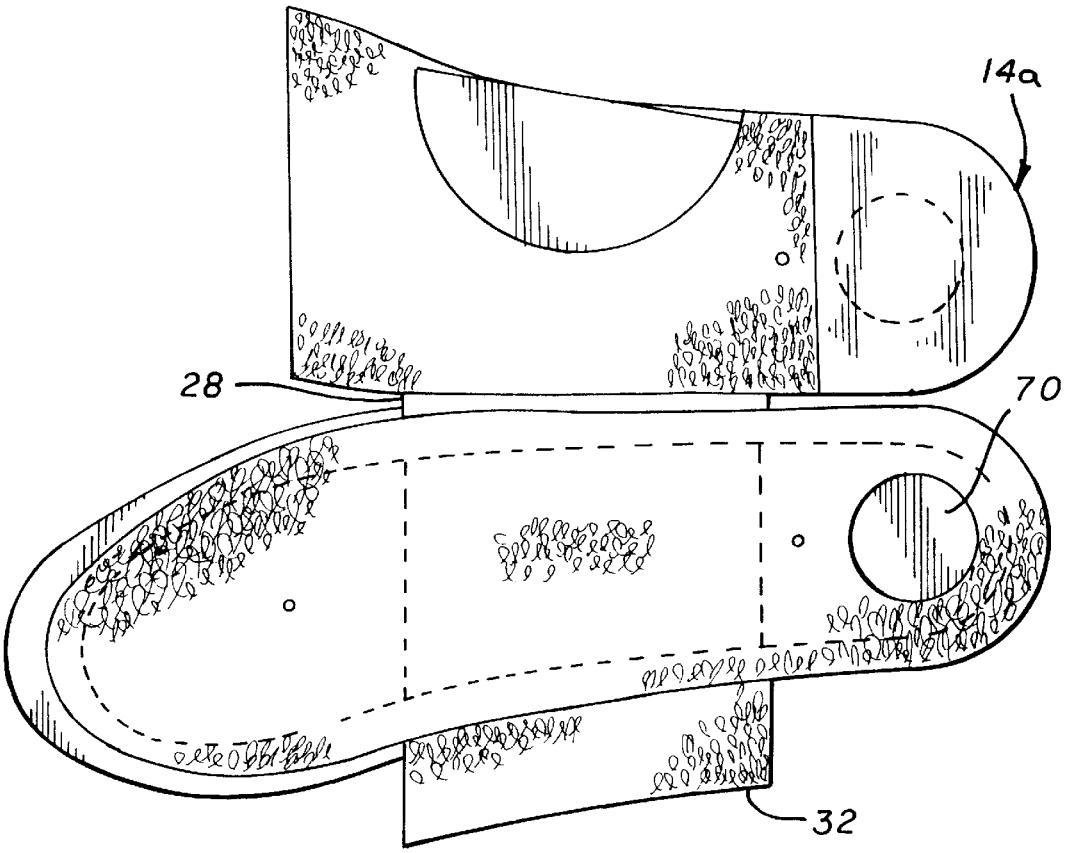
FIG. 6 is a variation of the orthotic device illustrated in FIG. 2 where the lower section is of partial length.
Figure 7:
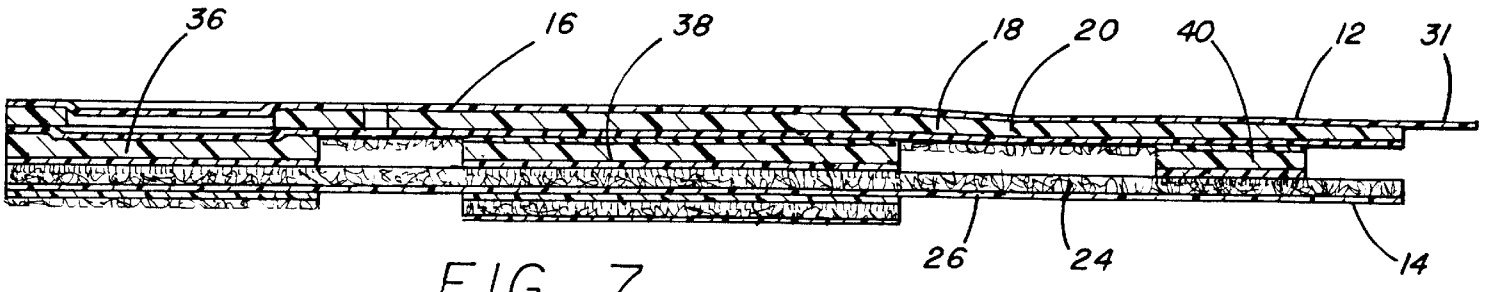
FIG. 7 is a view in section of the orthotic device of the invention incorporating cushion pads taken along line 7—7 of FIG. 5.
Figure 8:
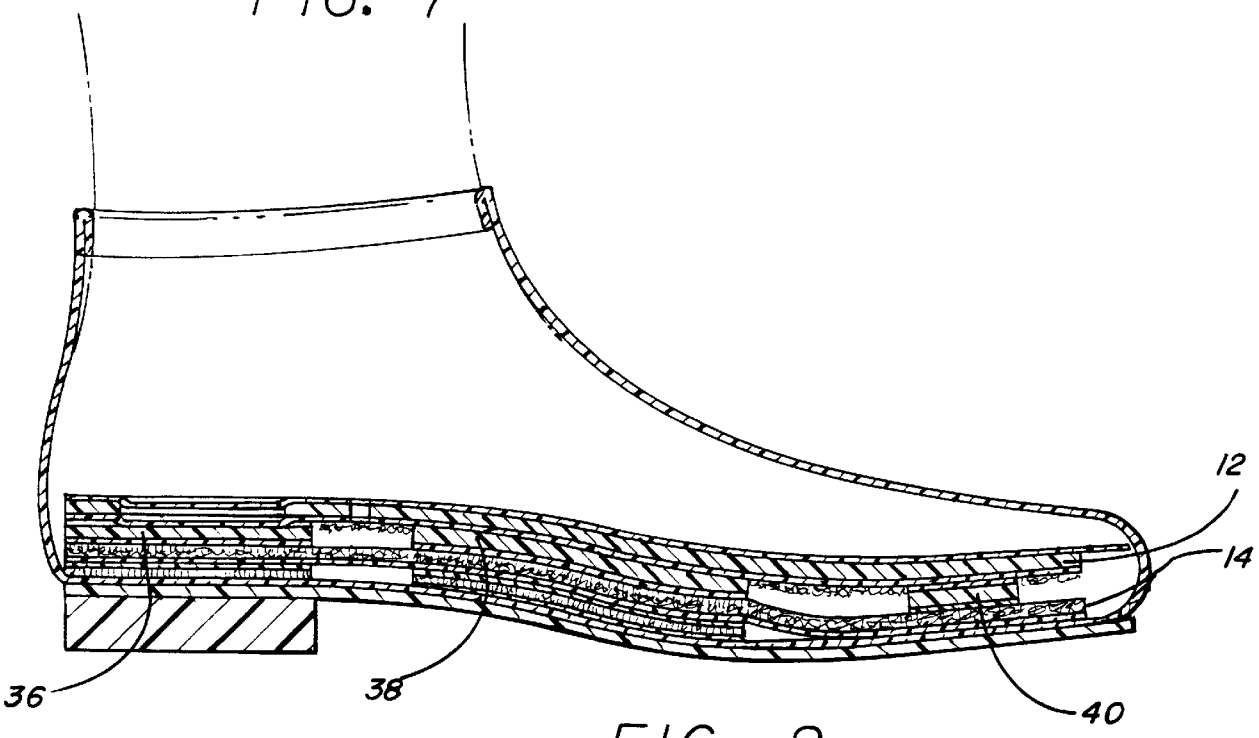
FIG. 8 is a side view in section illustrating placement of the orthotic device illustrated in FIG. 7 in a shoe.

Referring now to FIGS. 1–8, the adjustable orthotic 10 of the invention comprises an upper section 12 and a lower section 14 with at least one pad sandwiched between. As shown in FIG. 7 three pads 36, 38 and 40 sandwiched between upper section 12 and lower section 14. Upper section 12 is a lamination having an upper foot contacting layer 16 made of a deformable layer such as high density polyethylene or leather attached to an attachment layer 20 such as a thin layer of HDPE. A resilient cushioning layer 18 can be disposed between layer 16 and attachment layer 22. In the preferred embodiment, a layer 22 having a Velcro-type loop surface is permanently attached to attachment layer 20 with loop surface 22 facing outward. An elongated piece of Velcro-type loop material 27 can be attached at one end to lower section 14 and extends out and away from lower section 14 and a middle segment 29 becomes a layer of upper section 12. The outer end of Velcro piece 27 distal from the attached end forms a flap 32. The portion of Velcro piece 27 between lower section 14 and upper section 12 defines a hinge 28. Elongated piece 27 is connected most commonly by either stitching and/or adhesive bonding to upper section 12 and lower section 14 so that hinge 28 will align both sections when the orthotic 10 is in the closed position. Additionally, the layers of upper section 12 are attached to one another by adhesive, flame bonding and/or by stitching 15 as indicated. The layer 16 can extend past layers 18 and 20 to form a lip 31. Once in the closed position, flap 32 is wrapped around to the bottom of lower section 14 where it is temporarily secured to hook area 34 as illustrated in FIG. 4.

Referring again to FIG. 7, upper section 12 is a flat, foot-shaped lamination comprising a foot-contacting surface material 16 which can be made from leather or other suitable cover material which provides comfort to a user's foot; a resilient cushioning layer 18, most preferably made from a closed cell, foamed organic resin such as a polyurethane, suitably Poron, and a foot plantar aspect shaping or molding layer 20 such as High Density Polyethylene (HDPE). Attached to the attachment layer 20 is Velcro-type loop surface 22 which faces away from upper section 12. Preferably, the surface area of foot-contacting layer 16 is slightly greater than the surface areas of the other layers of both upper section 12 and lower section 14. FIG. 3 best illustrates the larger surface area for foot-contacting layer 16. The larger surface area is designed so that a user's foot will only contact the foot-contacting layer 16 of the orthotic 10 thereby providing maximum comfort.

The lower section 14 comprises a flat, foot-shaped lamination comprising a layer of attachment material such as Velcro-type loop material 24 bonded to a foot-shaped layer of HDPE 26 or other suitable flexible, non-compressible material. Preferably, the bottom face of lower section 14 will have a velcro-type hook area 34 bonded to HDPE layer 26 so that flap 32 may be temporarily secured to hook area 34 when the orthotic 10 is in the closed position.

Figure 18:
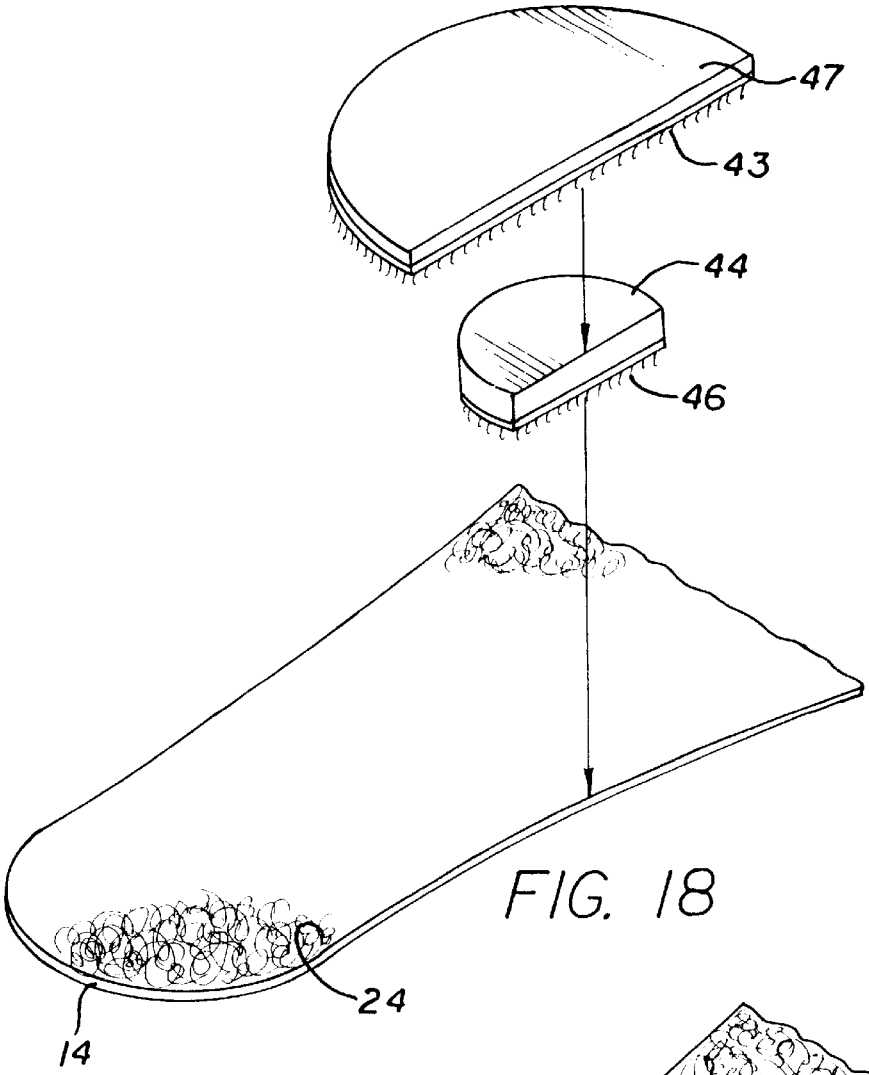
FIG. 18 is an exploded view of two cushion pads positioned upon the Velcro surface of the lower portion.
Figure 19:
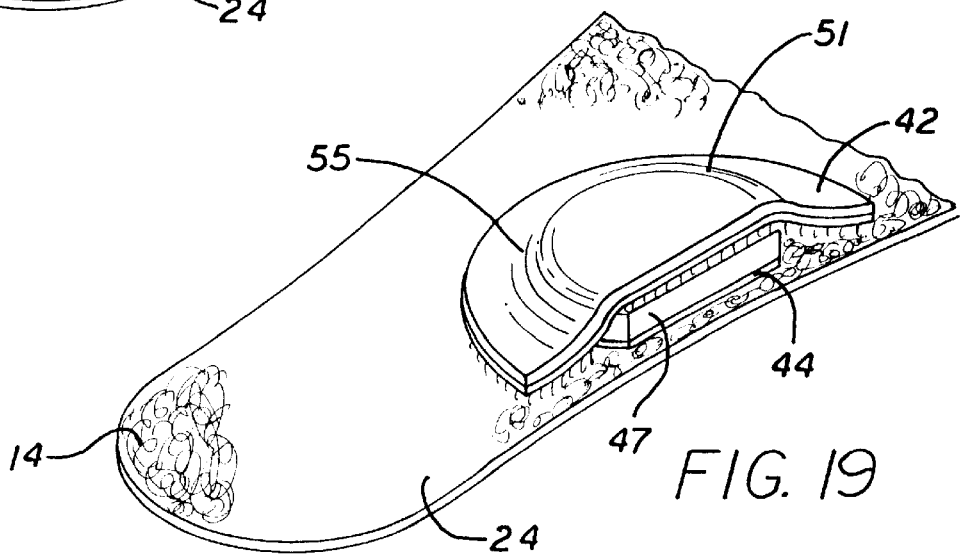
FIG. 19 is a perspective view of the cushion pads of FIG. 18 positioned upon the Velcro surface of the lower portion.

The pads sandwiched between sections 12 and 14 can be in any position. As best illustrated by FIG. 18, pads 42 and 44 preferably have Velcro-type hook areas 43 and 45 attached to one face so that both may be temporarily secured to the Velcro-type loop material located on either the bottom face of upper section 12 or the top surface of lower section 14. FIG. 19 illustrates pads 42 and 44 stacked and temporarily attached to loop material 24 of lower section 14.

Since upper section 12 and lower section 14 comprise respective laminated layers, in the most preferable embodiment, registration apertures 46 are cut or punched from each individual layer. During assembly of upper section 12 and lower section 14, apertures 46 are used to facilitate a quick and proper alignment of each layer before permanently attaching the lamination by stitching, adhesive bonding or other conventional attachment means.

Nesting Bowl and Heel Pad

Figure 9:
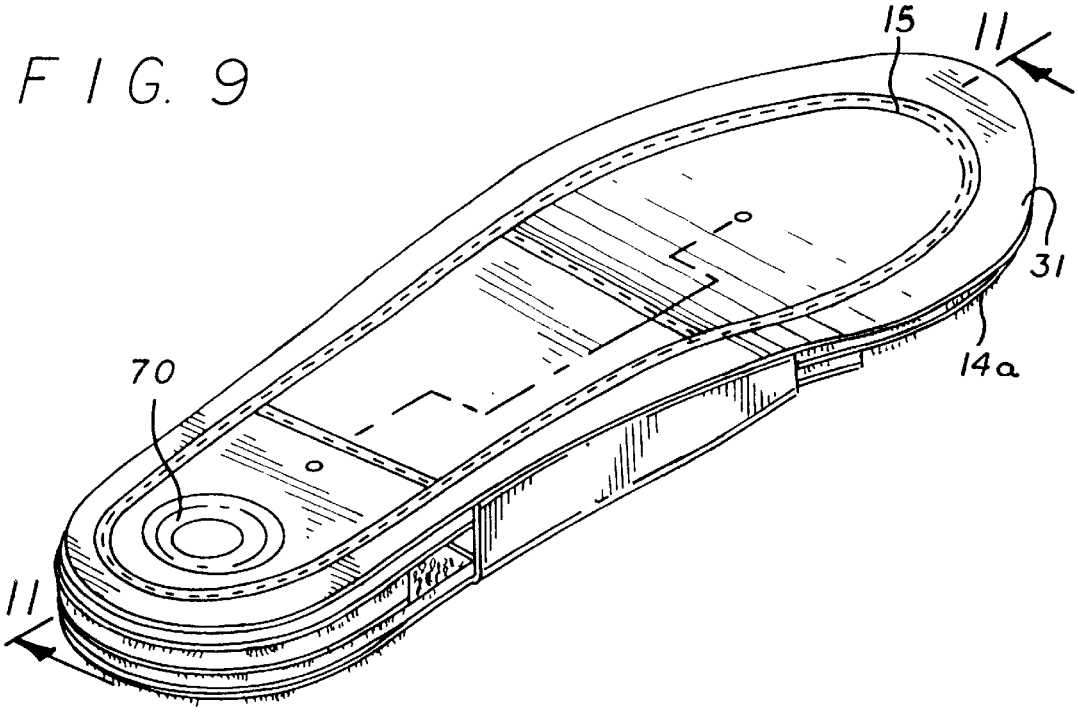
FIG. 9 is a perspective view of the orthotic device of the invention illustrated in FIG. 6 ready for use.
Figure 10:
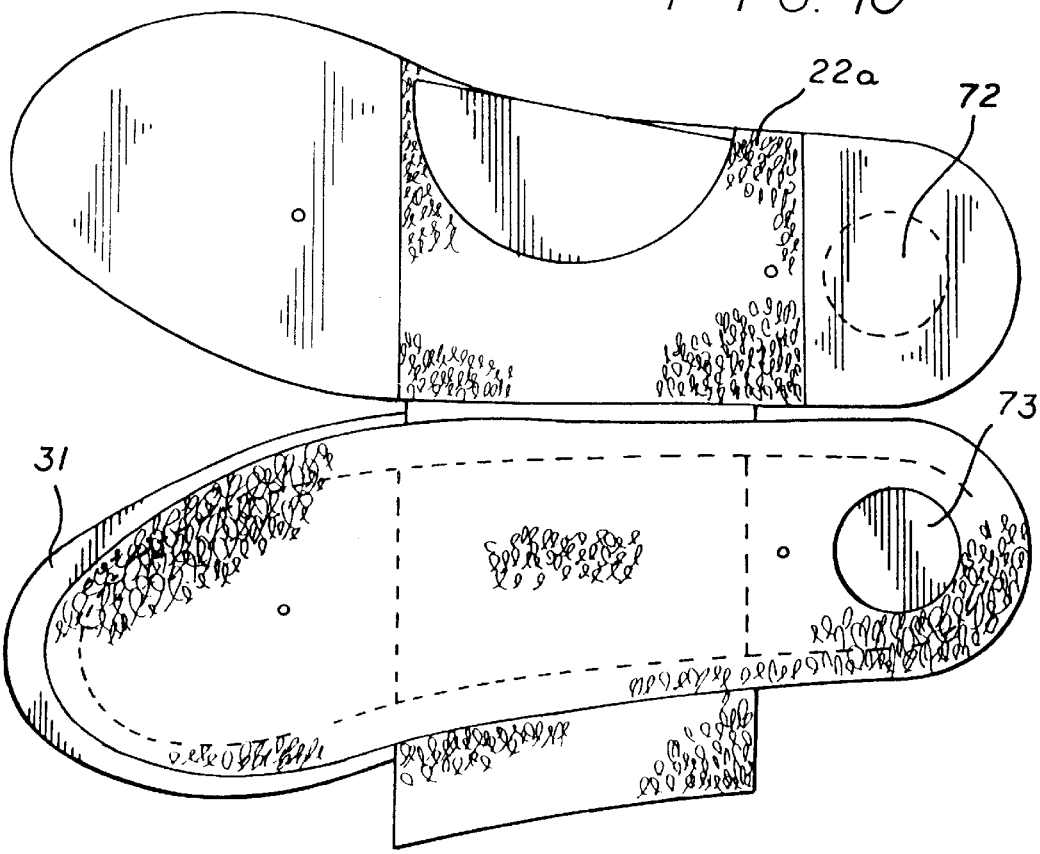
FIG. 10 is a top view of an alternative embodiment of the orthotic device of the invention illustrating the use of Velcro on the upper section and partially on the lower section.
Figure 11:
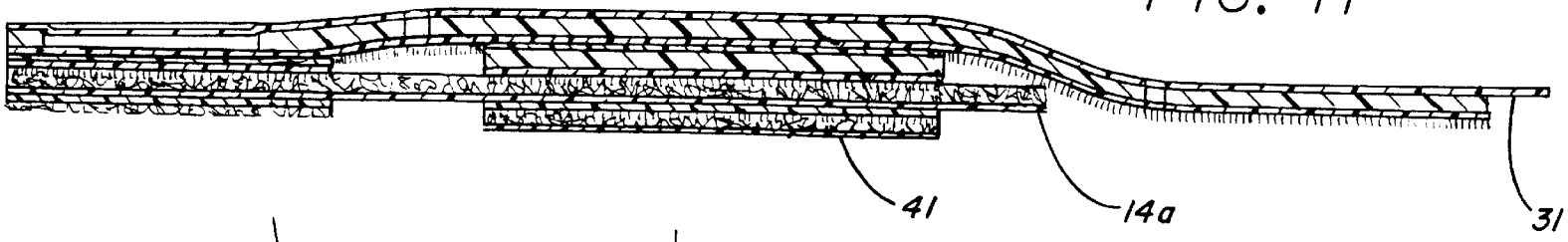
FIG. 11 is a side view in section taken along line 11—11 of FIG. 9.

As illustrated in FIGS. 1, 2 and 9 through 13, the top rear surface area of the upper-section 12 can have a circular nesting bowl area 70 for receiving the calcaneus region of the user's heel bone. The extension of the material of the bowl area 70 can be increased by forming a circular cavity 73 through lamination layers 18, 20 and 22 of upper section 12. To further enhance the depth of bowl area 70, further corresponding cavities can be formed through layers 24 and 26 of lower section 14 as depicted in FIG. 2 at 72. To further cushion this region, a heel pad can be placed on top of the rear portion of the loop bed of the lower section. This heel pad can be thin or thick, soft or firm to suit the needs of the patient. Another feature illustrated in FIGS. 5–6 and 9 is the use of a lower section 14*a* of reduced length such that the upper portion of the section is not present. This embodiment is useful in dress shoes where space can be limited. In the embodiment illustrated in FIG. 10, both the heel portion and the metatarsal portion of the loop cloth are not present which forms a central band 22*a* of loop material.

Alternative embodiments of special heel supports are depicted in FIGS. 13, 14, 15 and 16.

FIG. 3 illustrates an adjustable orthotic 10 having an elongated trapezoidal resilient pad 21 positioned on the sheet 24*a* of loop material normal to the axis of the orthotic and adjacent the metatarsal region. A semicircular arch pad 23 is positioned on the sheet of Velcro on the bottom section 14. The sheet 24*a* of attachment material is not present in the heel area of the device 10. When the assembly is closed the hook material 48 on the upper section 12 will be exposed and can be sued to releasably attach pads.

FIGS. 9 through 12 illustrate an orthotic device in which the layer 22*a* of loop cloth is present only on the middle section os the upper layer 20. Pads 41 can be adhered to the lower surface of the lower section 14*a* by adhesive or by releasable loop-hook attachment system.

Figure 12:
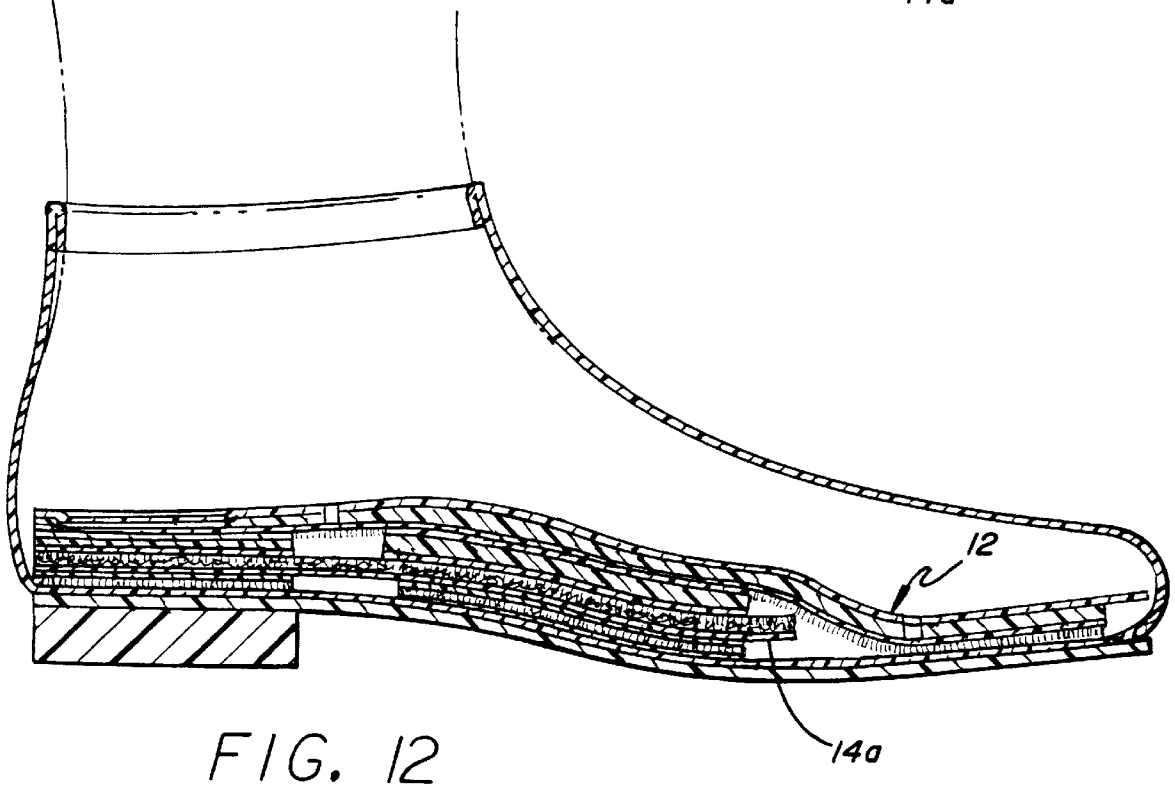
FIG. 12 is a view in section illustrating placement of the embodiment of the orthotic device illustrated in FIG. 11 in a shoe.
Figure 13:
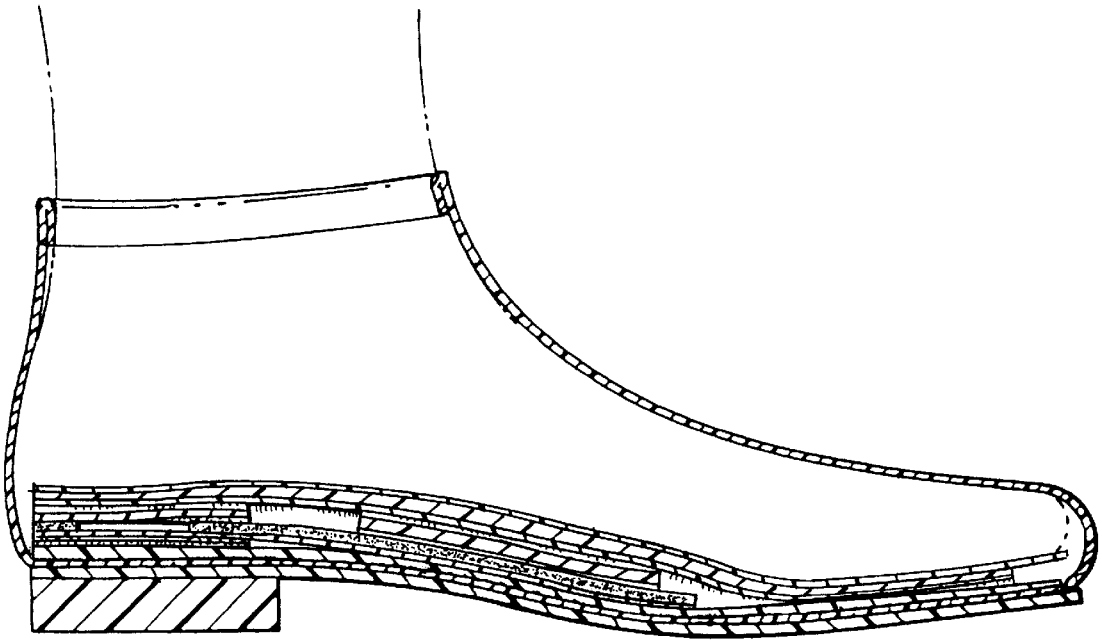
FIG. 13 is a view in section of another embodiment of an orthotic device placed in a shoe.

FIG. 13 illustrates a slimmer version of the orthotic of FIG. 12.

Figure 14:
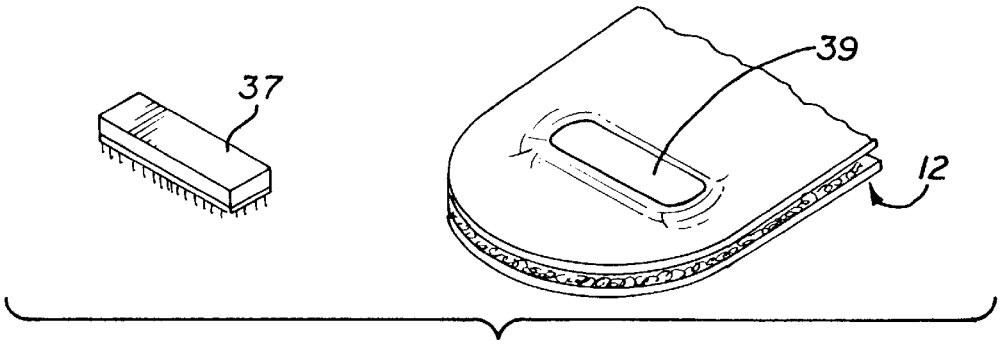
FIG. 14 is a perspective view of a first embodiment of a heel cushion pad assembly.
Figure 15:
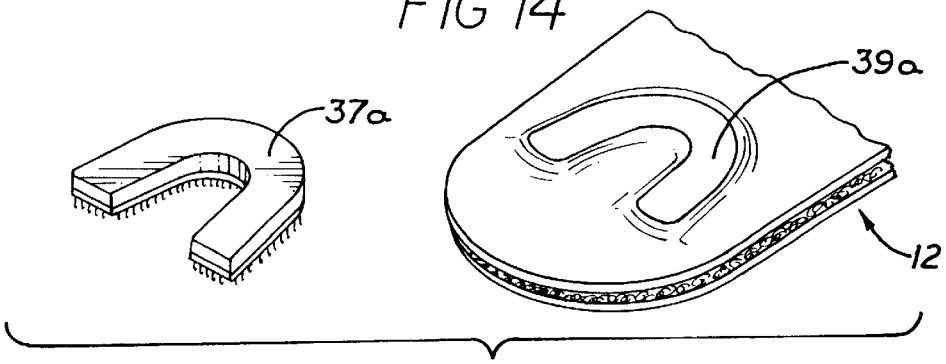
FIG. 15 is a perspective view of a second heel cushion pad assembly.

FIG. 14 illustrates an upper section 12 of an orthotic with a rectangular section 37 removed to form a rectangular cavity 39. FIG. 15 illustrates an upper section 12 with a U-shaped section 37*a* removed from the heel portion to form a U-shaped stress relief cavity 39*a*.

Figure 16:
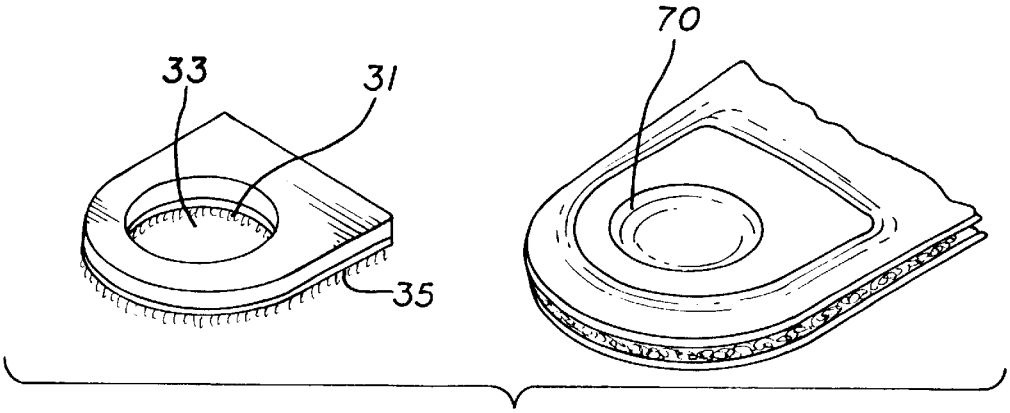
FIG. 16 is a perspective view of a third embodiment of a heel cushion pad assembly.

FIG. 16 illustrates a heel pad 31 containing an aperture 33 adapted to be secured by a layer 35 of hook material to the layer 29 of loop material on the upper sections 12 of the orthotic. The aperture 33 is positioned below the heel cup.

Figure 17:
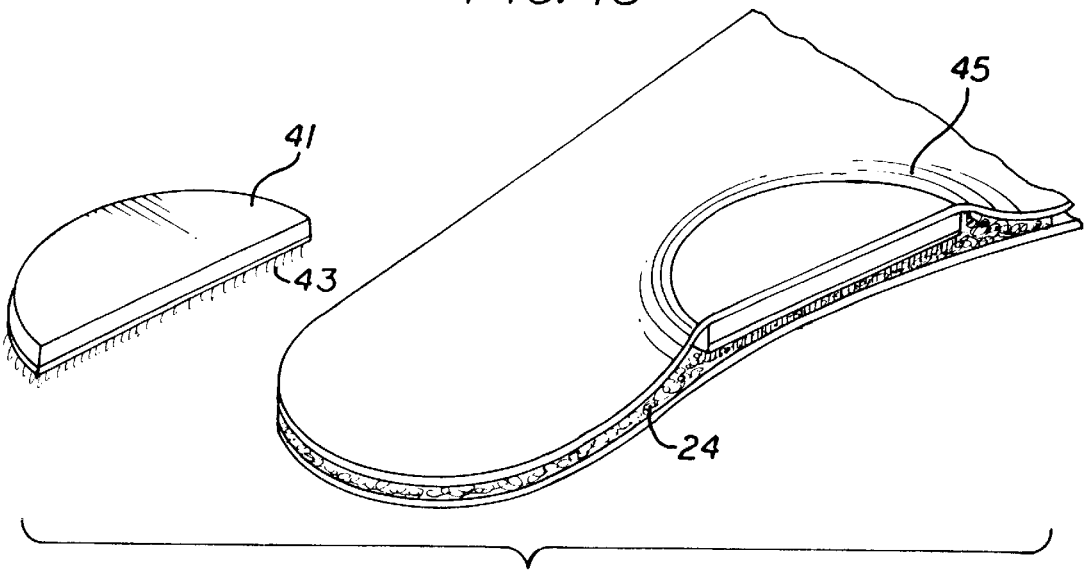
FIG. 17 is a perspective view of a cushion pad disposed between the upper and lower sections.

FIG. 17 illustrates a shoe orthotic 10 having a semicircular cushioning pad 41 with a layer 43 of hook material attached to the layer 24 of loop material on the bottom section 14. The gradual slope 45 of the top section 12 as it deformed and conforms to the shape of the pad 41 is evident. FIGS. 18 and 19 illustrate attaching a stack 47 of compressible pads to the loop surface 24 of a lower section 14 of a three layer orthotic device. A first smaller semicircular pad 44 having a hook layer 46 is attached to the loop fabric 24 at the arch area. The second larger pad 42 having a hook layer 49 is stretched over the pad 44 and hook layer 46 engages the loop layer 24 surrounding the smaller pad 44 to form a ramp with a rounded edge 51 and smooth transitionary surface 55.

Figure 20:
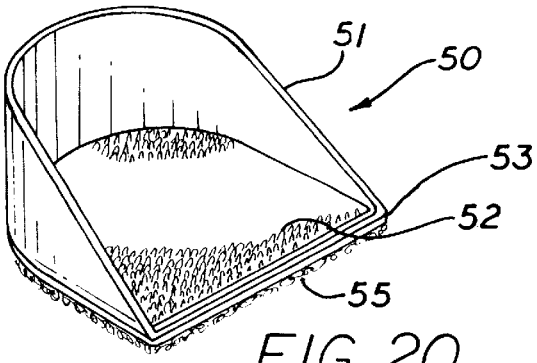
FIG. 20 is a perspective view of a heel cup attachment.

Optional Heel Cup

Where additional support is required in the heel area, heel cup 50 can be temporarily attached to the lower section 14 of the orthotic 10. As best illustrated by FIG. 20, heel cup 50 comprises a resilient molded body 51 made preferably from HDPE, having a layer of loop material 52 attached to the flat base 53 of the cup 50, facing outward. The inside flat area of heel cup 50 can also have a layer of hook material 55.

In order for heel cup 50 to be frictionally attached to the orthotic 10, a layer of loop material 48 can be attached to the bottom face of lower section 14 as shown in FIG. 4. The inside flat area of heel cup 50 is slightly larger than the heel area of the orthotic 10 so that the orthotic 10 may be snugly received and thereafter temporarily attached by the contact of loop material 48 on lower section 14 to hook layer 55 on heel cup 50.

Figure 21:
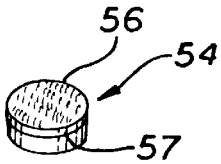
FIG. 21 is a perspective view of a heel post.
Figure 22:
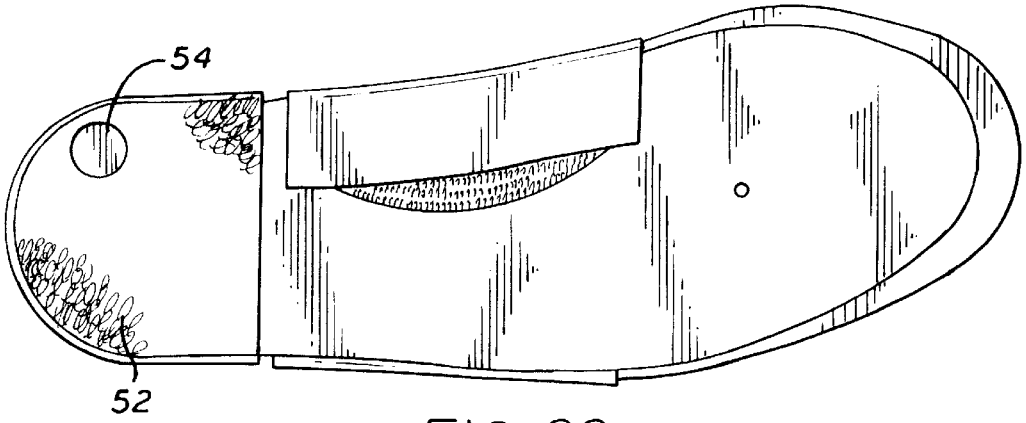
FIG. 22 a bottom view of the orthotic device of the invention incorporating the heel cup illustrated in FIG. 20 and heel post illustrated in FIG. 21.

As shown in FIGS. 21 and 22, loop material 52 attached to base of cup 50 can frictionally engage a heel post 54. The post 54 preferably has a rigid body 57. The purpose of the post 54 is to provide additional height to a user's heel for proper alignment. One side of post 54 can have an area of hook material 56 for frictionally attaching to any portion of the base of heel cup 50 which is covered with loop material 52.

Figure 23:
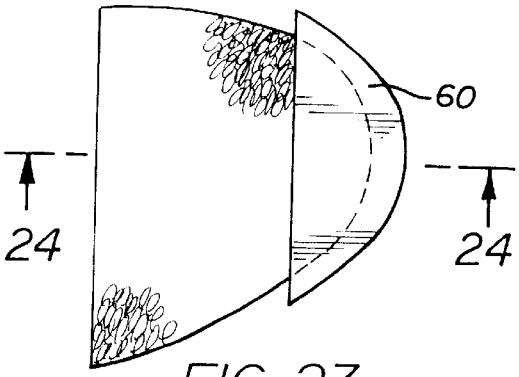
FIG. 23 is a top view of an extender element mounted upon the Velcro surface of the lower portion.
Figure 24:
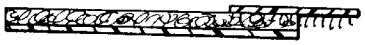
FIG. 24 is a side view taken along line 24—24 of FIG. 23.

Optional Extender Element

Where required, an adjustable extender element 60 may be utilized to improve fit of the orthotic 10 in footwear. Referring to FIGS. 23 and 24, the purpose of extender element 60 is to increase the overall length of the orthotic 10 so that when inserted into a shoe, slippage within a shoe will be minimized or negated. The adjustable element 60 is formed of a non-compressible layer 62 having a lower hook layer 64 for attachment to the loop layers 22, 24 on sections 12, 14. The orthotic 10 can be made in various sizes. Element 60 can eliminate the need for the orthotic 10 to be made in half-sizes.

Extender element 60 comprises a thin, partial elliptical sheet of HPDE 62 and an area of hook material 64 bonded to one side. Hook material 64 is frictionally attached to either upper section loop material 22 or lower section loop material 24.

Figure 25:
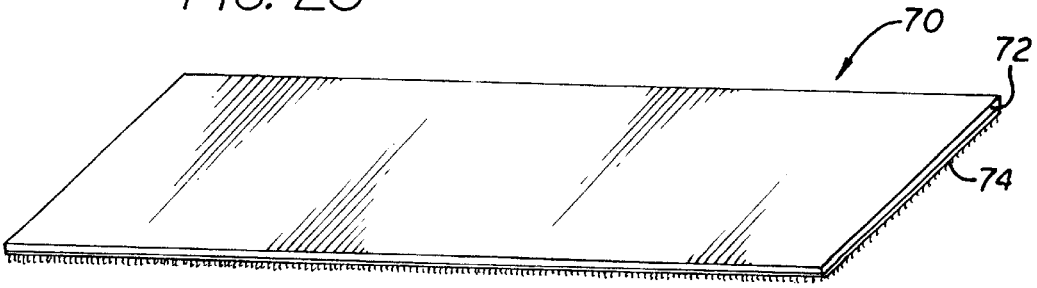
FIG. 25 illustrates a uniform layer of pad material having hook material attached to one side.

FIG. 25 illustrates a sheet 70 containing a layer of compressible padding material 72 laminated to a layer of hook material 74. Custom pads can be scissor or die cut from the sheet 70.

Figure 26:
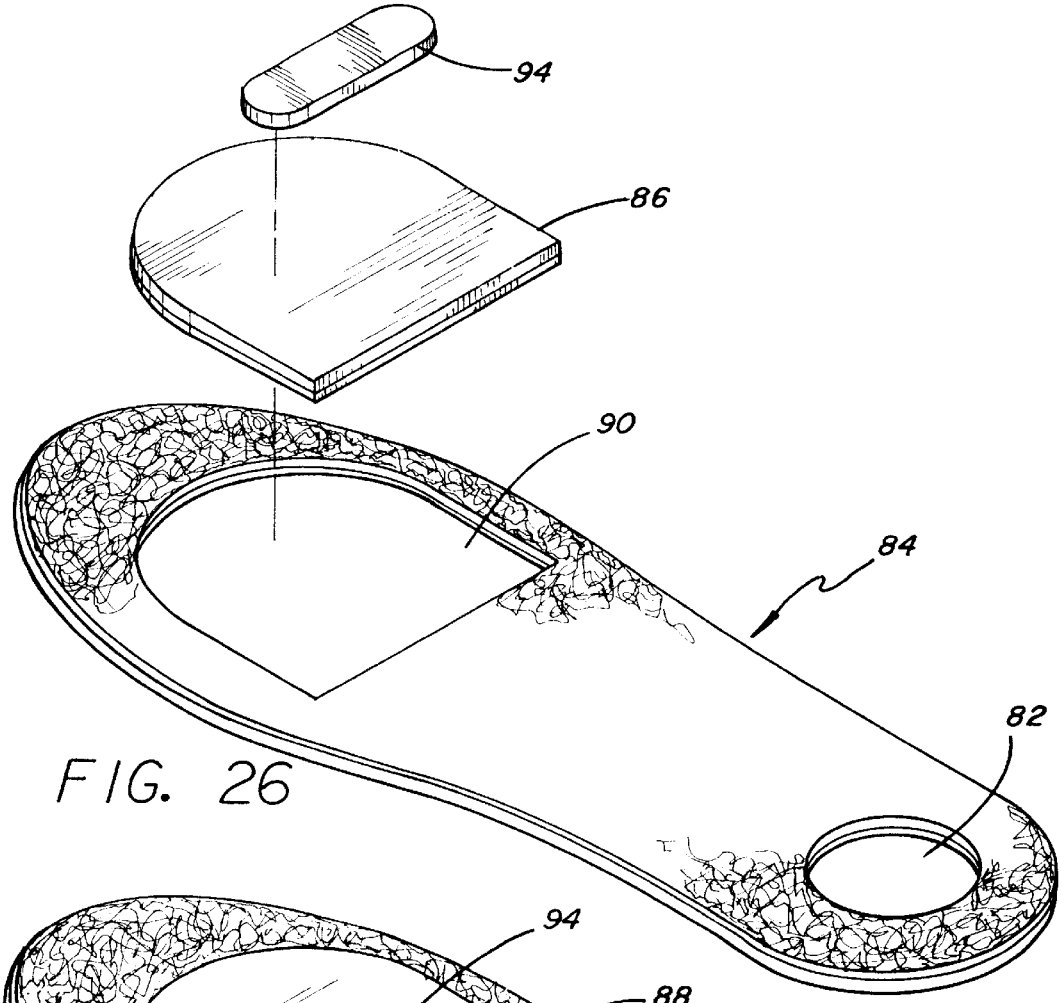
FIG. 26 is an exploded view of a cushioning pad configuration for the front section of an orthotic.
Figure 27:
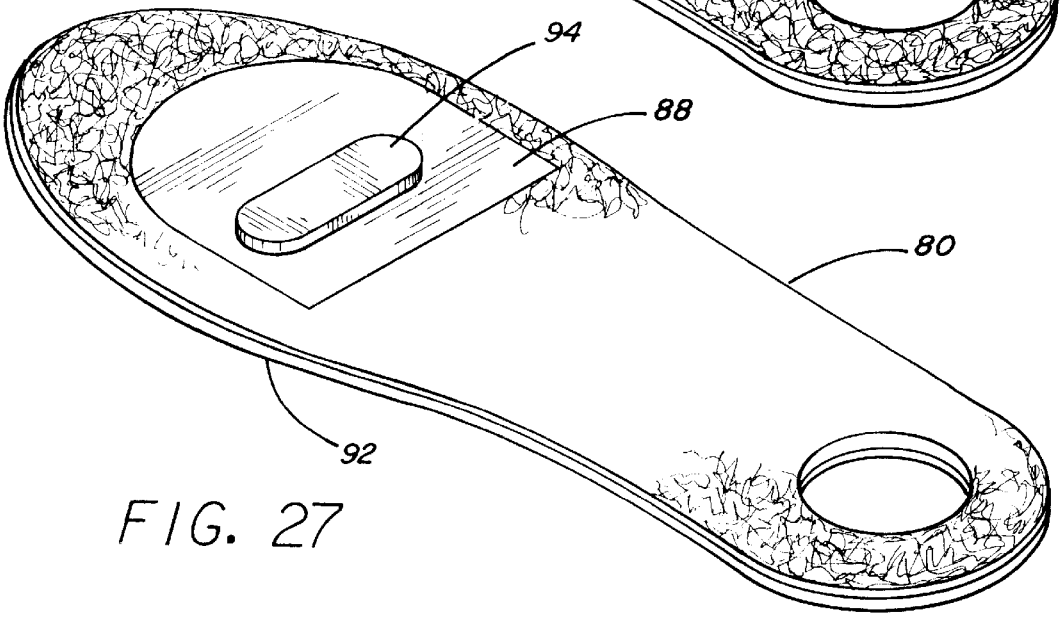
FIG. 27 is a perspective view of the assembled embodiment of an orthotic device illustrated in FIG. 26.

FIGS. 26 and 27 illustrate an adjustable orthotic 80 having a cylindrical cavity 82 in the heel portion of the upper section 84 of the orthotic. A panel 86 can be removed from the upper section to form a large aperture 90. The layer 88 of loop material on the lower section 92 is exposed so that smaller pads 94 having a layer of hook fabric can be attached to the layer 88 of loop material within the aperture 90.

It is to be realized that only preferred embodiments of the invention have been described and that numerous substitutions, modifications and alterations are permissible without departing from the spirit and scope of the invention as defined in the following claims.

I claim:

1. An orthotic shoe device comprising:

an upper section comprising a non-compressible, deformable foot-contacting surface layer and a first sheet of attachment material selected from hook or loop fabric and attached to said foot-contacting surface layer, said upper section further having a toe end and a heel end;

a lower section comprising a flexible layer attached to a second sheet of attachment fabric selected from loop or hook material bonded to one side of said flexible layer, said lower section further having a toe end and a heel end; and at least one compressible cushion pad, said pad having hook or loop attachment material extending away from at least one surface of said pad; said cushion pad being disposed between said lower section and said upper section and attached to at least one of said sheets of attachment material.

2. An orthotic shoe device according to claim 1 further including layer of resilient material disposed between said foot contacting surface layer and said first sheet of attachment material.

3. An orthotic device according to claim 1 in which a layer of hook or loop attachment material is secured to both surfaces of the pads and said pad layers engage the opposed sheets of hook or loop material on said first and second sections.

4. An orthotic device according to claim 1 in which said first section further comprises a lower flexible, non-compressible layer.

5. An orthotic device according to claim 4 in which a sheet of separable attachment material is adhered to said flexible, non-compressible layer.

6. An orthotic device according to claim 5 in which a layer of compressible material is adhered between said surface layer and said lower flexible, non-compressible layer to form a laminate.

7. An orthotic device according to claim 6 in which the sheets of attachment material are flexible loop material.

8. An orthotic device according to claim 7 in which sheets of hook material are adhered to both surfaces of said pads.

9. An orthotic device according to claim 4 further comprising a means for hinging said upper section to said lower section.

10. An orthotic device as recited in claim 5 wherein said hinging means comprise an elongated strip of loop or hook fabric material having a first and second end, said first end secured to said lower section; said strip further having a middle portion integral with said upper section, the portion of said strip between said lower section and said upper section defining a hinge, the portion of said elongated strip extending away from said upper section to said second end defining a flap, said lower section further having an area of hook or loop material attached to the bottom face of said lower section said flap being capable of attaching to said area of hook or loop material when at least one of said cushion pads is disposed between said upper section and said lower section.

11. An orthotic device as recited in claim 1 further comprising a heel cup having a base and a side wall, said heel cup configured to receive the heel ends of said lower and upper sections where said side wall is in or near contact with the sides of said upper and lower sections, said heel cup is further temporarily attached to said lower section of said device by the use of separable attachment material selected from hook or loop material.

12. An orthotic device as recited in claim 11 further comprising a heel post and means temporarily attaching the post to the bottom face of said heel cup base.

13. An orthotic device as recited in claim 1 wherein said upper section contains an aperture through said surface layer defining a nesting bowl area positioned for alignment with the calcaneus region of the heel bone of a human foot when positioned upon said upper section.

14. An orthotic device as recited in claim 1 further comprising an extender element comprising a patch of material in the shape of a toe section of footwear having a layer of hook or loop fabric releasably secured to the sheet of hook or loop material on the upper or lower sections of the device.

* * * * *